United States Patent [19]

Sasaki

[11] Patent Number: 4,548,390

[45] Date of Patent: Oct. 22, 1985

[54] SPRING UNIT

[75] Inventor: Noboru Sasaki, Tokyo, Japan

[73] Assignee: France Bed Co., Ltd., Tokyo, Japan

[21] Appl. No.: 605,698

[22] Filed: May 1, 1984

[30] Foreign Application Priority Data

May 10, 1983 [JP] Japan ..... 58-81463

[51] Int. Cl.[4] ..... F16F 3/04

[52] U.S. Cl. ..... 267/91; 5/246; 5/255; 5/256; 267/95; 267/100

[58] Field of Search ..... 267/80, 91, 93, 95, 267/100, 101, 103, 105, 110, 154, 155, 157; 5/246, 247, 248, 255, 256, 475, 476, 254

[56] References Cited

U.S. PATENT DOCUMENTS

| | | | |
|---|---|---|---|
| 598,493 | 2/1898 | Ahlborn | 267/91 |
| 1,248,956 | 12/1917 | Vincent | 267/91 X |
| 1,694,995 | 12/1928 | Thomas | 5/248 X |
| 3,052,460 | 9/1962 | Nachman, Jr. | 267/100 |
| 3,286,281 | 11/1966 | Slominski | 5/255 X |
| 4,012,802 | 3/1977 | Hutchinson et al. | 267/105 X |
| 4,238,861 | 12/1980 | Mizelle | 5/247 |

FOREIGN PATENT DOCUMENTS

| | | | |
|---|---|---|---|
| 0001458 | of 1859 | United Kingdom | 267/91 |

*Primary Examiner*—Bruce H. Stoner, Jr.

*Assistant Examiner*—Robert J. Oberleitner

*Attorney, Agent, or Firm*—Merchant, Gould, Smith, Edell, Welter & Schmidt

[57] ABSTRACT

A spring unit comprises a rectangular base plate, a rectangular frame, first main springs, second main springs, third main springs and fourth main springs arranged on the base plate, and intermediate support springs also placed on the base plate. Each of the first and third main springs has one straight rod portion and two coil portions which are connected at one end to the ends of the straight portion. Each of the second and fourth main springs has one straight rod portion and two torsion bar spring portions which are connected at one end to the ends of the straight rod portion. The first and second main springs are parallel to each other and alternately arranged on said rectangular base plate. The third and fourth main springs are parallel to each other and alternately arranged on said rectangular base plate, with the straight rod portions arranged at right angles to those of the first and second main springs. Clips fasten the other end of each coil portion and the other end of each torsion bar spring portion to the base plate. Other clips couple one end of each coil portion and one end of each torsion bar spring portion to the frame. Other clips couple one end of each support spring to the associated rod portion. Still other clips fasten the other end of each support spring to the base plate.

7 Claims, 15 Drawing Figures

SPRING UNIT

BACKGROUND OF THE INVENTIN

The present invention relates to a spring unit for use in a mattress or a box spring.

A conventional spring unit used in a mattress or a box spring comprises a plurality of first main springs and a plurality of second main springs shorter than the first ones. Each main spring is made of one wire and has a straight rod portion and two spring portions. The spring portions are coupled at the upper end to the ends of the rod portion, respectively. The main springs are arranged on a rectangular base plate. More precisely, the first main springs are arranged parallel to the long sides of the base plate, whereas the second main springs are arranged parallel to the short sides of the base plate. Hence, the first and second main springs form a lattice. The lower ends of the spring portions of each spring are secured to the four edges of the base plate. The rod portions of the main springs are supported by intermediate support springs. Like the main spring, each intermediate support spring has a straight rod portion and two spring portions. The spring portions are coupled at the upper end to the ends of the rod portion, and at lower end to the base plate.

In the known spring unit, the spring portions of the main springs and intermediate support springs are torsion bar springs. A torsion bar spring deforms very slightly when a compressive load is applied to it. But, it will be permanently deformed if compressed many times. The spring unit, which comprises torsion bar springs, may lose its elasticity in a relatively short time.

SUMMARY OF THE INVENTION

Therefore, the object of the present invention is to provide a spring unit which retains a high elasticity over a long period of time.

According to the invention, there is provided a spring unit which comprises: a rectangular base plate; a plurality of first main springs each having one straight rod portion and two coil portions which are connected at one end to the ends of the straight portion; a plurality of second main springs each having one straight rod portion and two torsion bar spring portions which are connected at one end to the ends of the straight rod portion, said first and second main springs being parallel to each other and alternately arranged on said rectangular base plate; a plurality of third main springs each having one straight rod portion and two coil portions which are connected at one end to the ends of the straight rod portion; a plurality of fourth main springs each having a straight rod portion and two torsion bar spring portions which are connected at one end to the ends of the straight rod portion, said third and fourth main springs being parallel to each other and alternately arranged on said rectangular base plate, with the straight rod portions arranged at right angles to those of the first and second main springs; first fastening means fastening the other end of each coil portion and the other end of each torsion bar spring portion to said rectangular base plate; a rectangular frame; first coupling means coupling said one end of each coil portion and said one end of each torsion bar spring portion to said rectangular frame; a plurality of first intermediate support springs arranged on said rectangular base plate; second coupling means coupling one end of each first intermediate support spring to the corresponding straight rod portion; and second fastening means fastening said other end of each first intermedite support spring to said rectangular base plate.

DETAILED DESCRIPTION OF THE PREFERRED EMBODIMENTS

Figure 1:
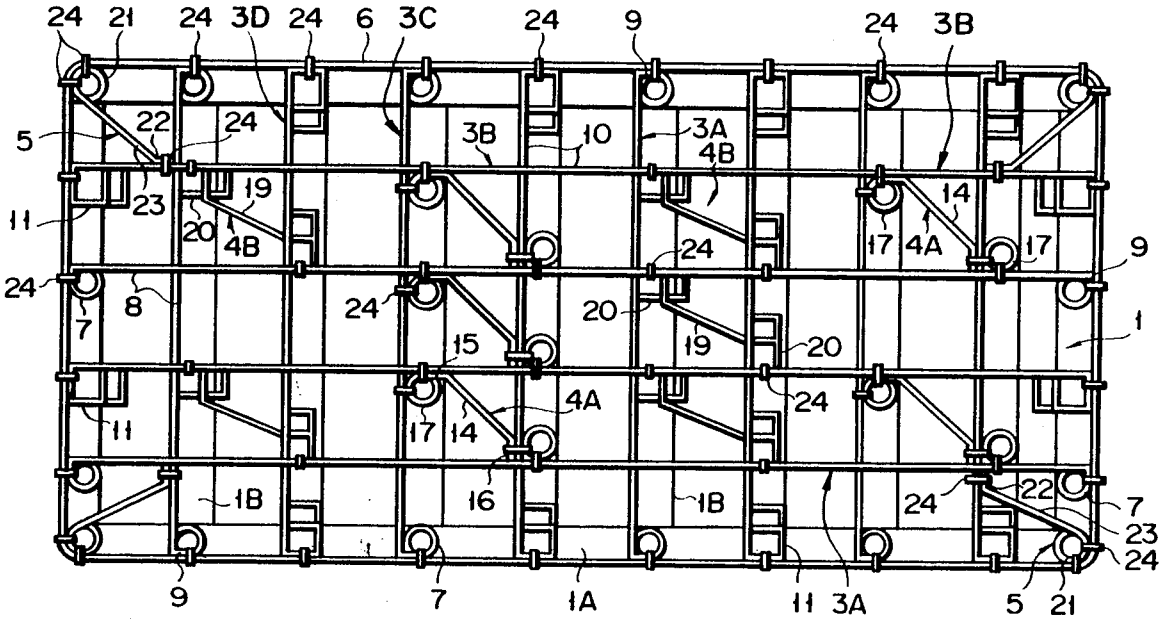
FIG. 1 is a schematic plan view of a spring unit according to the present invention.
Figure 2:
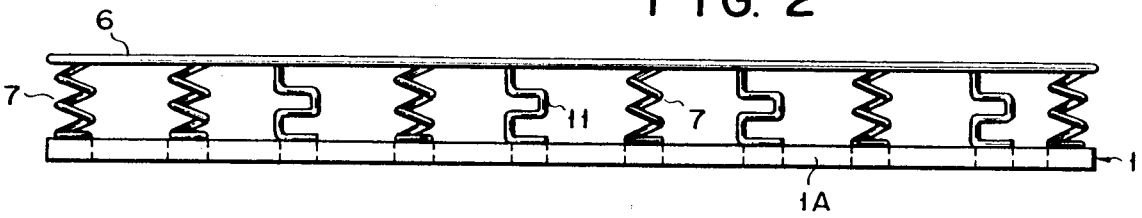
FIG. 2 is a side view of the spring unit shown in FIG. 1.

As shown in FIGS. 1 and 2, a spring unit, an embodiment of the invention, has a base plate 1. The plate 1 comprises a rectangular base frame 1A and a plurality of crosspieces 1B fixed to the base frame 1A. The crosspieces 1B are parallel to the short sides of the base frame 1A and are spaced apart from one another at equal intervals. The spring unit further comprises a plurality of first main springs 3A, a plurality of second main springs 3B, a plurality of third main springs 3C, a plurality of fourth main springs 3D, a plurality of first intermediate support springs 4A, a plurality of second intermediate support springs 4B, four corner springs 5 and a rectangular wire frame 6. The springs 3A, 3B, 3C, 3D and 5 are disposed in a specific manner, as will be described later.

The rectangular wire frame 6 is made of a steel wire having a circular sectional profile. Its size is substantially the same as that of the base plate 1.

Figure 3:
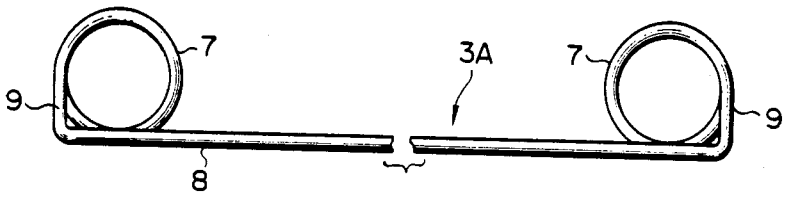
FIG. 3 is a plan view of one of the first main springs of the spring unit.
Figure 4:
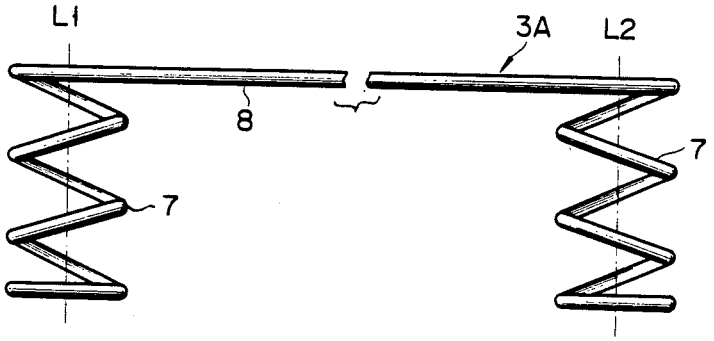
FIG. 4 is a side view of the first main spring shown in FIG. 3.

As shown in FIGS. 3 and 4, each first main spring 3A is made of a straight rod portion 8 and two coil portions 7 each with a straight segment 9. One end of each straight segment 9 is continuous to the end of the rod portion 8. The axis L1 of one of the coil portions 7 and the axis L2 of the other coil portion are parallel as illustrated in FIG. 4. The straight segments 9 are substantially at right angles to the rod portions 8, as shown in FIG. 3.

Figure 5:
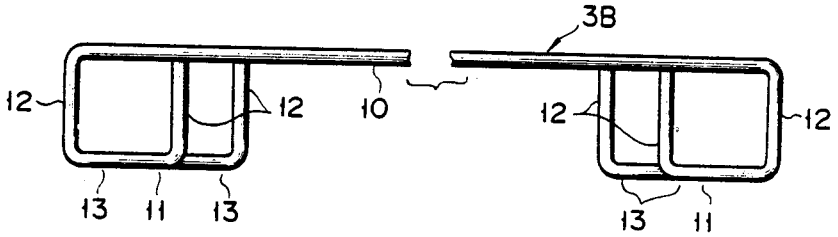
FIG. 5 is a plan view of one of the second main springs of the spring unit.
Figure 6:
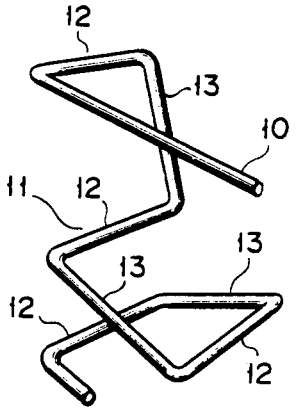
FIG. 6 is a perspective view of one of the torsion bar spring portions of the second main spring shown in FIG. 5.

As shown in FIG. 5, each second main spring 3B is also made of a steel wire having a circular sectional profile. It has a straight rod portion 10 and two torsion bar spring portions 11. As shown in FIG. 6, each torsion bar spring 11 is made of a rod which is so bent as to have three parallel, horizontal portions 12 and three slant portions 13.

The third main springs 3C have the same structure as the first main springs 3A but are shorter than the first main springs 3A. The fourth main springs 3D have the same strucure as the second main springs 3B but are shorter than the second main springs 3B.

Figure 7:
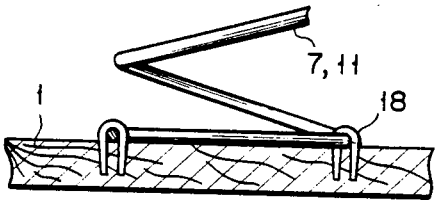
FIG. 7 is a side view of a portion of a base plate and a portion of a coil portion secured to the plate.

On the base plate 1, first main springs 3A and second main springs 3B are alternately arranged parallel to the long sides of the frame 1A, and third main springs 3C and fourth main springs 3D are alternately arranged parallel to the short sides of the frame 1A. Hence, the rod portions 8, 10 of the these main springs 3A, 3B, 3C, 3D form a latice. As illustrated in FIG. 7, the portions 7 of the first and third main springs are secured at the other ends to the frame 1 by staples 18. Similarly, the portions 11 of the second and fourth main springs are secured at the other end to the frame 1 by staples 18.

Figure 8:
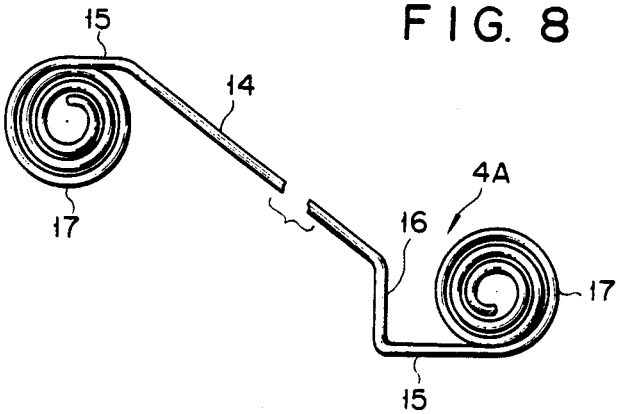
FIGS. 8 and 9 are plan views of the first and second intermediate support springs of the spring unit.

Each first intermediate support spring 4A is made of one steel wire having a circular sectional profile, like each first main spring 3A. As shown in FIG. 8, it has a straight rod portion 14, first straight segment 15, a second straight segment 16, and two coil portions 17. One of the segments 15 is continuous at one end to one end of the segment 16, the other end of which is continuous to one end of the rod portion 14. The other segment 15 is continuous at one end to the other end of the rod portion 14. The upper end of the first coil portion 17 is continuous to the other end of the first straight segment 15, and the other coil portion 17 is continuous to the other end of the straight segment 15. One of the straight segments 15 and the second straight segment 16 are at at right angles to each other, forming an L-shaped portion.

Figure 9:
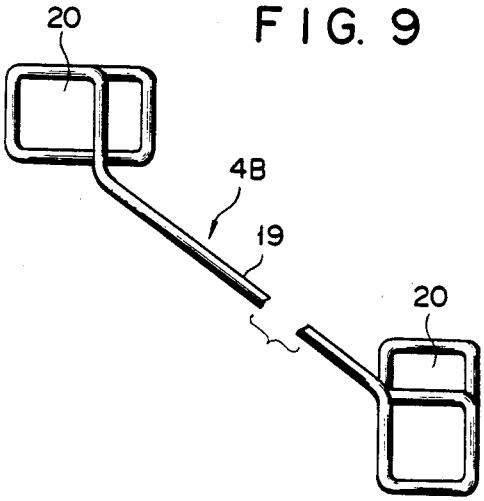

Each second intermediate support spring 4B is also made of a single steel wire having a circular profile. As shown in FIG. 9, it has a straight rod portion 19 and two torsion bar spring portions 20, like each second main spring 3B. The torsion bar spring portions 20 are made by bending the end portions of the steel wire, like the torsion bar spring portions 11 of the each second main spring 3B (FIG. 5). Unlike the portions 11 of the second main spring 3B, the torsion bar spring portions 20 extend in different directions.

The straight rod portions 14, 19 of each intermediate support spring 4A or 4B are much shorter than the straight rod portions 8, 10 of main springs 3A, 3B, 3C, 3D. More specifically, their length is substantially equal to the diagonal length of each box of the lattice formed by the rod portions 8, 10 of the main springs. In the second and fourth rows of lattice boxes, two first intermediate support springs 4A are located in the fourth and eighth boxes, and two second intermediate support springs 4B are located in the second and sixth boxes. Further, a first intermediate support spring 4A and a second intermediate support spring 4B are located in the fourth and sixth boxes of the third row.

As shown in FIG. 1, each corner spring 5 is made of one steel wire having a circular sectional profile. It has a coil portion 21, a straight portion 23, and a straight segment 22. The segment 22 is continuous to one end of the straight portion 23 and inclined at a particular angle thereto. The upper end of the coil portion 21 is continuous to the other end of the straight portion 23.

Figure 10:
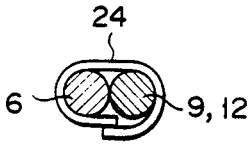
FIG. 10 is a enlarged, sectional view of a pair of wires bound together.

As shown in FIG. 1 and 10, the rectangular wire frame 6 is fastened, by clips 24, to the straight segments 9 of the first main spring 3A and third main springs 3C and to the torsion bar spring portions 11 of the second main spring 3B and fourth main springs 3D. The upper end of one coil portion 17 of each first intermediate support spring 4A is fastened by a clip 24 to the rod portion 8 of the third main spring 3C. The first straight segments 15 of each spring 4A are fastened by clips 24 to the straight rod portions 8, 10 of the first and second main springs 3A and 3B. The second straight segment 16 and the upper end of the other coil portion 17 of each spring 4A are fastened by clips 24 to the straight rod portion 10 of the fourth main spring 3D.

The torsion bar spring portions 20 of each second intermediate support spring 4B are fastened at the upper end by clips 24 to the rod portions 8, 10 of the first and second main springs 3A and 3B. The upper end portion of the coil portion 21 of each corner spring 5 is fastened at two points by clips 24 to the corresponding corner portion of the frame 6. The straight segment 22 of each corner spring 5 is fastened by a clip 24 to the straight rod portion 8 of a first main spring 3A or to the straight rod protion 10 of a second main spring 3B.

The clips 24 are metal strips having a predetermined width. Each clip 24 is bent around two steel wires, thus bundling them together.

As mentioned above, the first main springs 3A each with two coil portions 7 and the second main springs 3B each with two torsion bar spring portions 11 are alternately arranged and parallel to the long side of the base plate 1. Further, the second main springs 3C each with two coil portions 7 and the fourth main springs 4D each with two torsion bar spring portions 11 are alternately arranged and parallel to the short side of the base plate 1. The first intermediate supprt springs 4A each with two coil portions 17 and the second intermediate support springs 4B each with two torsion bar spring portions 20 are arranged alternately in the lengthwise direction of the base plate 1. Therefore, the coil portions 7, 17 which may be easily compressed and the torsion bar spring portions 11, 20 which are hard to compress provide a proper elasticity to the entire spring unit.

The torsion bar spring portions 11, 20 may be permanently deformed after a long use of the spring unit. By contrast, the coil portions 7, 17 will be permanently deformed but only by very little. Should the torsion bar spring portions 11, 20 be permanently deformed, the coil portions 7, 17 could maintain the elasticity of the spring unit over a long use.

Figure 11:
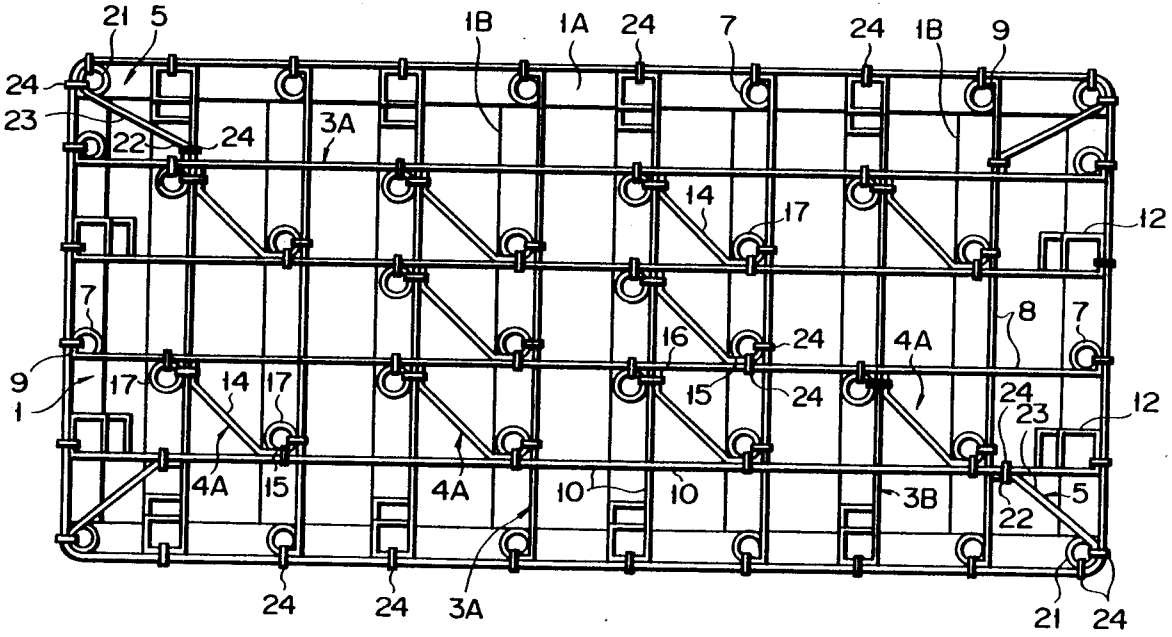
FIG. 11 is a schematical plan view of another spring unit according to the invention.

FIG. 11 shows another spring unit according to the present invention. This embodiment is different from the embodiment shown in FIG. 1 in that only first intermediate support springs 4A are used. Since the coil portions 17 of the springs 4A support the straight rod portion 8, 10 of first, second, third and fourth main springs 3A, 3B, 3C and 3D at many points, the straight rod portions 8 and 10 can maintain their own elasticity over a long period of time.

In the above-described embodiment, the spring unit is assembled by the main spring 3A, intermediate spring 3B and corner spring 5 having the cylindrical coil portions 7, 17, 21.

Figure 12A:
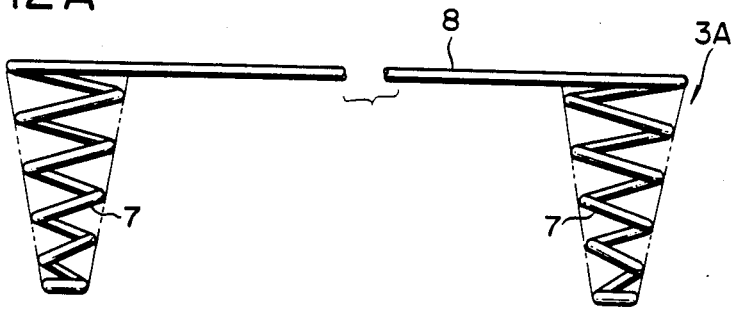
FIGS. 12A to 12D are side views of the main spring of another type respectively.

However, the coil portions 7 of each main spring 3 may be shaped like an inverted cone as shown in FIG. 12A. In other words, their diameter may decreased along their axes toward their lower ends. Their diameter is not so large that they touch each other. The coil portions 17 of each intermediate support spring 3B and the coil portions 17 of each corner spring 5 also may be identical with these coil portions 7 in shape and diameter. The coil portions 7, 17 and 21 are indeed more liable to elastically deform than torsion bar springs when a compressive load is applied on them, but they are less liable to permanent deformation than torsion bar springs. Hence, their elasticity is preserved over a long period of time, unlike that of torsion bar springs.

As mentioned above, in the modified embodiment, the coil portions 7, 17, 21 are shaped like an inverted cone. Hence, when a load acts on each coil portion 7, 17, 21 the turn of the greatest diameter is first elastically deformed, the turn of the second greatest diameter is then deformed, and so forth. When the spring unit is used as bed spring unit, it can comfortably support the user lying on the bed, regardless of his weight. In other words, the bed is neither too soft nor too hard to the user. Since the diameter of the coil portion 7, 17, 21 decreases toward the lower end, the turns do not contact one another when the coil portion 7 is compressed, thus generating no noise.

Figure 12B:
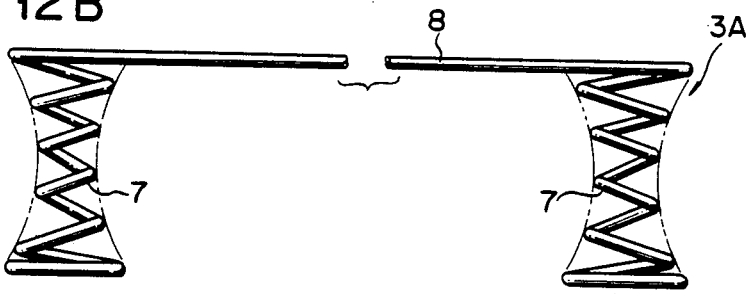
Figure 12C:
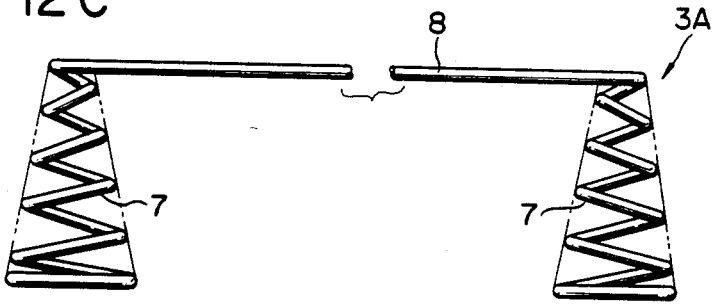
Figure 12D:
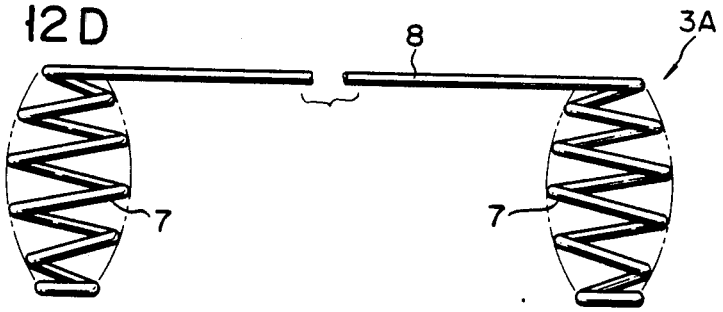

According to the present invention, the shape of the coil portions of each main spring 3A, intermediate spring 3B or each corner spring 5 is not limited to the cylindrical shape or the inverted cone shape. The coil portion may take any other non-cylinderical shape. For example, it may be shaped like a hourglass as shown in FIG. 12B. Alternatively it may have such a conical shape as illustrated in FIG. 12C. Further, it may be shaped like a barrel as depicted in FIG. 12D.

In the embodiment described above, each main spring 3A is made of a single steel wire. Instead, it may be formed of two sections each of which is made of a steel wire. In this case, each section may have a straight rod element portion and a coil spring portion. The straight rod element portion of the sections may be coupled to that of the other section, thus forming a main spring 3 which has one straight rod portion consisting of the two coupled rod element portions.

As described above, according to this invention, first main springs each with two coil portions and second main springs each with two torsion bar spring portions are arranged alternately and parallel to the long side of a rectangular base plate. Further, the third main springs each with two coil portions and fourth main springs each with two torsion bar spring portions are arranged alternately and parallel to the short side of the base plate. Therefore, the coil portions 7, 17 which may be easily compressed and the torsion bar spring portions 11, 20 which are hard to compress provide a proper elasticity to the entire spring unit. The torsion bar spring portions may be permanently deformed after a long use of the spring unit. By contrast, the coil portions 7, 17 will be permanently deformed but only by very little. Should the torsion bar spring portions be permanently deformed, the coil portions could maintain the elasticity of the spring unit over a long use. Moreover, since the first and second main springs are alternately arranged and the third and fourth main springs are alternately arranged, the spring unit of the invention has a uniform elasticity.

What is claimed is:

1. A spring unit comprising:

a rectangular base plate;

a plurality of first main springs each having one straight rod portion and two coil portions which are connected at one end to the ends of the straight portion;

a plurality of second main springs each having one straight rod portion and two torsion bar spring portions which are connected at one end to the ends of the straight rod portion, said first and second main springs being parallel to each other and alternately arranged on said rectangular base plate;

a plurality of third main springs each having one straight rod portion and two coil portions which are connected at one end to the ends of the straight rod portion;

a plurality of fourth main springs each having a straight rod portion and two torsion bar spring portions which are connected at one end to the ends of the straight rod portion, said third and fourth main springs being parallel to each other and alternately arranged on said rectangular base plate, with the straight rod portions of said third and fourth main springs arranged at right angles to the straight rod portions of the first and second main springs;

first fastening means fastening the other end of each coil portion and the other end of each torsion bar spring portion to said rectangular base plate;

a rectangular frame;

first coupling means coupling said one end of each coil portion and said one end of each torsion bar spring portion to said rectangular frame;

a plurality of first intermediate support springs arranged on said rectangular base plate;

second coupling means coupling one end of each first intermediate support spring to at least one of said first, second, third or fourth main spring straight rod portion; and second fastening means fastening said other end of each first intermediate support spring to said rectangular base plate.

2. A spring unit according to claim 1, wherein each of said first intermediate support springs has a straight rod portion shorter than those of said first, second, third and fourth main springs and has two second coil portions connected at one end to one end of the straight rod portion.

3. A spring unit according to claim 2, wherein the coil portions of each first intermediate support spring are coil springs.

4. A spring unit according to claim 3, further comprising a plurality of second intermediate support springs placed on said rectangular base plate, each of which has a straight rod portion shorter than those of first, second, third and fourth main springs and has two torsion bar spring portions connected at one end to one end of the straight rod portion.

5. A spring unit according to claim 1, wherein said one end of each coil portion of any main spring has a straight segment which is in tight contact with said rectangular frame.

6. A spring unit according to claim 2, wherein said one end of each coil portion of any first intermediate support spring has a straight segment which is in tight contact with the straight rod portion of the corresponding main spring.

7. A spring unit according to claim 1, wherein the two coil portions of each first or third main spring have axes parallel to each other, with one end coupled to the corresponding end of the straight rod portion of the first or third main spring.

* * * * *